US006990693B2

(12) United States Patent
Reschewitz

(10) Patent No.: US 6,990,693 B2
(45) Date of Patent: Jan. 31, 2006

(54) SEATING ELEMENT FOR A PAIR OF CYCLIST'S PANTS

(76) Inventor: Michael Reschewitz, Via XX Settembre, 33, I-25019 Sirmione (IT)

( * ) Notice: Subject to any disclaimer, the term of this patent is extended or adjusted under 35 U.S.C. 154(b) by 173 days.

(21) Appl. No.: 10/381,390

(22) PCT Filed: Sep. 21, 2001

(86) PCT No.: PCT/EP01/10941

§ 371 (c)(1),
(2), (4) Date: Mar. 11, 2004

(87) PCT Pub. No.: WO02/24013

PCT Pub. Date: Mar. 28, 2002

(65) Prior Publication Data

US 2004/0143890 A1 Jul. 29, 2004

(30) Foreign Application Priority Data

Sep. 22, 2000 (DE) ..... 100 47 517
Jan. 11, 2001 (DE) ..... 101 00 900

(51) Int. Cl.
*A41B 9/00* (2006.01)

(52) U.S. Cl. ..... 2/228; 2/69; 2/466; 2/467

(58) Field of Classification Search ..... 2/466, 2/467, 228, 238, 227, 267, 214; 602/67.72, 602/19; 450/97–99; 5/653; 297/219.11, 200–202, 297/214, 195.13, 195.1
See application file for complete search history.

(56) References Cited

U.S. PATENT DOCUMENTS 3,788,314 A * 1/1974 Noreen ..... 602/67
4,132,228 A * 1/1979 Green ..... 601/57
4,811,427 A * 3/1989 Regan ..... 2/466
4,945,571 A * 8/1990 Calvert ..... 2/467
4,961,233 A * 10/1990 Black ..... 2/228
5,249,306 A * 10/1993 Morris ..... 2/466
5,271,101 A * 12/1993 Speth et al. ..... 2/228
5,628,739 A * 5/1997 Hsieh et al. ..... 604/385.21
5,978,970 A * 11/1999 Bright ..... 2/267
6,029,281 A 2/2000 Battley
6,393,618 B2 * 5/2002 Garneau ..... 2/228
6,687,917 B2 * 2/2004 Forsyth et al. ..... 2/228

FOREIGN PATENT DOCUMENTS

EP 0 776 615 A2 6/1997
WO WO 99/41134 * 8/1999

OTHER PUBLICATIONS

Stedman's Medical Dictionary, 26th ed., 1995, p. 1329.

* cited by examiner

*Primary Examiner*—Gloria M. Hale
(74) *Attorney, Agent, or Firm*—Griffin & Szipl, P.C.

(57) ABSTRACT

A seat element for being inserted into a pair of cycling pants comprises a seat pad (10) for padding a seat surface in the bottom region. Further, the seat element comprises a bowl-shaped protective element (12) for the protection of the male genital region. The protective element (12) is connected with the seat pad (10). In the middle portion of the seat element, i.e., following the protective element (12), a vein protection channel (24) is provided. Because of the vein protection channel (24), a constriction of the vein extending in that region is avoided. Thereby, a circulation of blood to the male genitals will even be ensured if one sits on a cycle saddle for a long time.

16 Claims, 2 Drawing Sheets

SEATING ELEMENT FOR A PAIR OF CYCLIST'S PANTS

FIELD OF THE INVENTION

The invention relates to a seat element for a pair of cycling pants.

BACKGROUND OF THE INVENTION

It is known to provide seat pads in cycling pants for padding the seat surface. Such pads are sewn in in the region of the crotch of the cycling pants. Due to the sewing, tensions may arise in the region of the seam which strongly stress the mostly thin cloth of the cycling pants. Further, since the cycling pants are stiffened in the region of the seat pad by the connection of the seat pad with the cycling pants, the cycling pants mostly consisting of a stretch material are no longer elastic in that region. Thus, the seat pad cannot move relative to the pants. This, in turn, may lead to tensions in the pants' material. Such tensions may lead to tears or damage to the pants. Such cycling pants are described, for example, in EP 0 776 615.

It is the object of the invention to provide a seat element for cycling pants by means of which the occurrence of tears is avoided.

SUMMARY OF THE INVENTION

This object is solved, according to the invention, with the features of a first seat element embodiment, which is a seat element for being inserted into a pair of cycling pants, comprising a seat pad (10) for padding a seat surface in the bottom region and a bowl-shaped protective element (12) for the male genital region connected with the seat pad (10). In accordance with a second seat element embodiment of the present invention, the first seat element embodiment is further modified so that an edge (14) of the protective element (12) is configured such that it at least partially contacts the skin of a person wearing the seat element and preferably completely surrounds the outer genital region. In accordance with a third seat element embodiment of the present invention, either the first or second seat element embodiment is further modified so that an outside (30) of the seat element is provided with an adhesive coating. In accordance with a fourth seat element embodiment of the present invention, the third seat element embodiment is further modified so that the adhesive coating covers the outside (30) only partially and is preferably configured in the form of stripes.

In accordance with a fifth seat element embodiment of the present invention, any one of the first through fourth seat element embodiments is further modified so that a connection element for the connection to the cycling pants is provided at an outside (30) of the seat element, preferably at an outside (30) of the seat pad (10). In accordance with a sixth seat element embodiment of the present invention, the fifth seat element embodiment is further modified so that the connection element is connectable to a stiffening element provided in the crotch portion and the cycling pants.

In accordance with a seventh seat element embodiment of the present invention, any one of the first through sixth seat element embodiments is further modified so that the seat pad (10) comprises a vein protection channel (34) in longitudinal direction. In accordance with an eighth seat element embodiment of the present invention, the seventh seat element embodiment is further modified so that the vein protection channel (34) extends at least to the protective element (12).

The seat element according to the invention is separated from the cycling pants and adapted to be inserted therein. The seat element comprises a seat pad for padding a seat surface in the bottom region. Since the seat element is adapted to be inserted into the cycling pants, there is no fixed connection between the cycling pants and the seat element. Thereby, the occurrence of seam tensions which may lead to damage to the pants is avoided. Further, the pants are still elastic in the region of the seat element. A relative movement between pants and seat element is also possible so that the wearing comfort is increased and damage to the pants due to increased tensions is avoided.

Due to the fact that the seat element is configured separately from the pants and inserted into the cycling pants, it is further possible to provide a protective element for the male genital region at the seat element. It is a bowl-shaped protective element by which the position of the penis and the testicles is defined. Providing the bowl-shaped protective element solves the problem that sport shorts such as cycling pants are often worn without underpants since they disturb and may cause grazes. But if male cyclists wear cycling pants without underpants, this leads to the fact that the position of the penis is not defined. This is extremely disagreeable. By providing the seat element according to the invention, the wearing comfort of the cycling pants is also increased without underpants.

Preferably, the edge of the protective element is configured such that it contacts, at least partially, the skin of the person wearing the seat element. In this case, the edge of the protective element surrounds the outer genital region preferably completely. This means that the male penis and the testicles are arranged within the bowl-shaped protective element and the bowl-shaped protective element is as completely flush as possible with the body. Thus, the outer genital region is preferably protected completely by the bowl-shaped protective element, the outer genital region being completely surrounded by the edge of the outer protective element apart from the connection site between the protective element and the seat pad. Thereby, an agreeable and comfortable hold is provided.

In order to fix the position of the seat element in the cycling pants, the outside of the seat element is provided with an adhesive coating. The adhesive coating is configured such that a low adhesion is created between the cycling pants and the seat element. This serves to avoid a slipping of the seat element. On the other hand, the adhesive effect is not so large that a firm connection between the cycling pants and the seat element is established. The elasticity of the cycling pants in the region of the seat element is not influenced by the adhesive coating or only to a very minor degree so. Therefore, the outside of the seat element is preferably only partially coated with the adhesive coating. Preferably, the adhesive coating is configured in the form of stripes.

Preferably, silicone or a silicone compound is used as an adhesive coating. The desired adhesive effect can be adjusted by an appropriate silicone compound.

For fixing the position of the seat element in the cycling pants, it is further possible to provide, for example, small hook loop fasteners, snap fasteners or the like. They are preferably arranged in the middle portion of the seat element or in the crotch of the pants. The seat pad arranged substantially behind this region as well as the protective element can thus be moved sufficiently relative to the cycling pants despite the connection between cycling pants and seat element. By such a connection, the elasticity of the cycling pants in the region of the seat element is not or only very slightly impaired.

For connecting the cycling pants with the seat element by means of buttons or the like, a stiffening element provided in the crotch portion of the cycling pants is preferably used. Such a stiffening element is an element preferably made of thermoplastic plastic material by which the connection of the cloth in this region is secured and further, a body depth of the pants is produced.

In a preferred embodiment, the seat pad comprises a vein protection channel extending in longitudinal direction. In the region of the crotch, a vein serving to provide for the male genitals extends directly beneath the skin surface of men. If one sits on a cycle saddle for a long time in particular, this vein will be constricted so that circulatory disturbances may occur. By the provision of the vein channel in this region, the blood circulation will be even ensured if one sits on a cycle saddle for a long time.

The provision of a vein protection channel represents an independent invention that is independent of the provision of a protective element for the genital region. This invention is also independent of the fact whether the seat pad is adapted to be inserted into cycling pants or is sewn therein so that the invention also encompasses a seat pad with vein protection channel sewn in a pair of cycling pants.

BRIEF DESCRIPTION OF THE DRAWINGS

Hereinafter, the invention will be explained in detail with respect to a preferred embodiment thereof with reference to the accompanying drawings. In the Figures.

DETAILED DESCRIPTION OF THE INVENTION

Figure 2:
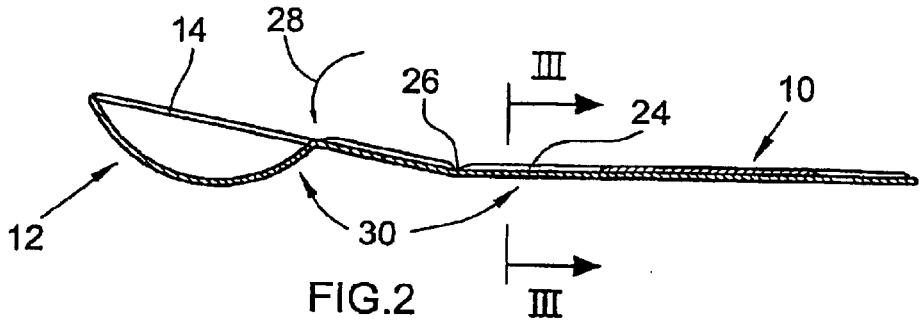
FIG. 2 is a schematic sectional view along the line II—II in FIG. 1.
Figure 3:
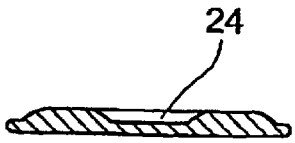
FIG. 3 is a sectional view along the line III—III in FIG. 2.

The seat element comprises a seat pad 10 arranged in the rear portion as well as a protective element 12 arranged in the front portion. In cross section, the protective element 12 is bowl-shaped (FIG. 2). An edge 14 of the protective element 12 is substantially arranged in a plane so that the edge 14 contacts the body of the person. The protective element 12 consists of padded cloth. The edge 14 is also soft and elastic to prevent the protective element from causing pressure marks on the body. Further, the wearing comfort is increased by the provision of soft material.

The seat pad 10 consisting of a soft cloth which is multi-layered, if necessary, and comprising a padding between the cloth layers comprises two seat surfaces 16. Between the seat surfaces 16, a groove 18 is provided to increase the flexibility so that the rear portion of the seat pad is configured so as to be bird tail-shaped.

The front portion of the seat pad 10 via which the seat pad 10 is connected with the protective element 12 comprises a narrowing 20 in the middle portion. In this portion, there is the crotch of the pants or the smallest distance of the thigh insides. In the direction of the protective element 12, the seat pad 20 expands again. Thereby, the position of the seat pad between the legs of the person wearing the seat pad is defined.

In order to further improve the wearing comfort, wings 21 of soft cloth are preferably provided in the region of the narrowing 20. The wings 21 are particularly supple and flexible. They contact the thigh inside and point downward when the seat pad is worn. Preferably, the wings 21 are made of a material comprising polyamide. Particularly, the material is calendered to get a soft smooth surface. Preferably, the grain of the cloth extends downward, i.e., towards the knees when the seat pad is worn, to avoid friction due to the movement occurring upon cycling, which would occur if a movement against the grain of the cloth occurred. Preferably, the wings 21 are made of a multi-layered material, one layer preferably consisting of polyurethane foam. Preferably, the layer contacting the skin is always a calendered polyamide.

Figure 1:
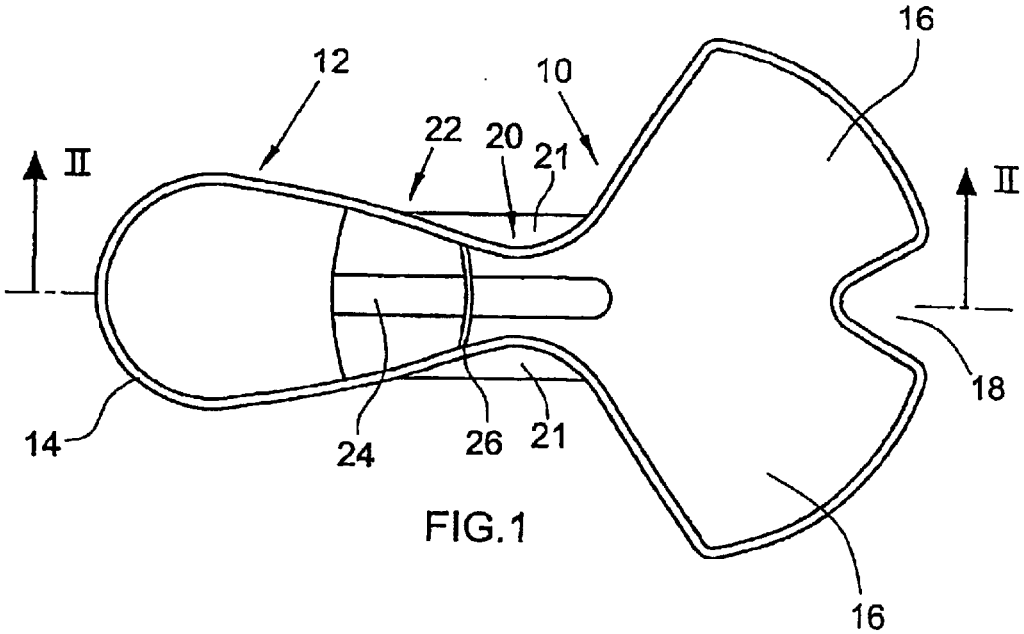
FIG. 1 shows a schematic top view of a seat element.

In longitudinal direction, i.e., in horizontal direction in FIG. 1, the seat pad comprises a vein protection channel 24 in the crotch region 22. The vein protection channel 24 extends from the seat surfaces 16 to the protective element 12 so that the vein extending in this region will not be constricted even if one sits on a cycle saddle for a long time. Preferably, the vein channel is 1–1.5 cm wide and has a depth of 2–4 mm.

A groove 26 is provided between the narrowing 20 and the protective element 12. Because of the groove 26, the protective element 12 can be moved in the direction of the arrow 28 (FIG. 2) with respect to the seat pad 10. Thereby, the wearing comfort is increased again.

Figure 4:
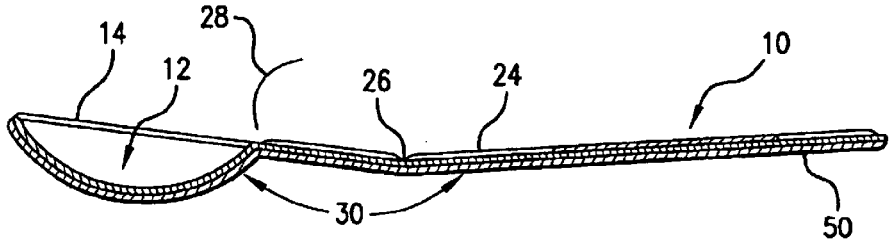
FIG. 4 is a schematic sectional view of another embodiment in accordance with the present invention.
Figure 5:
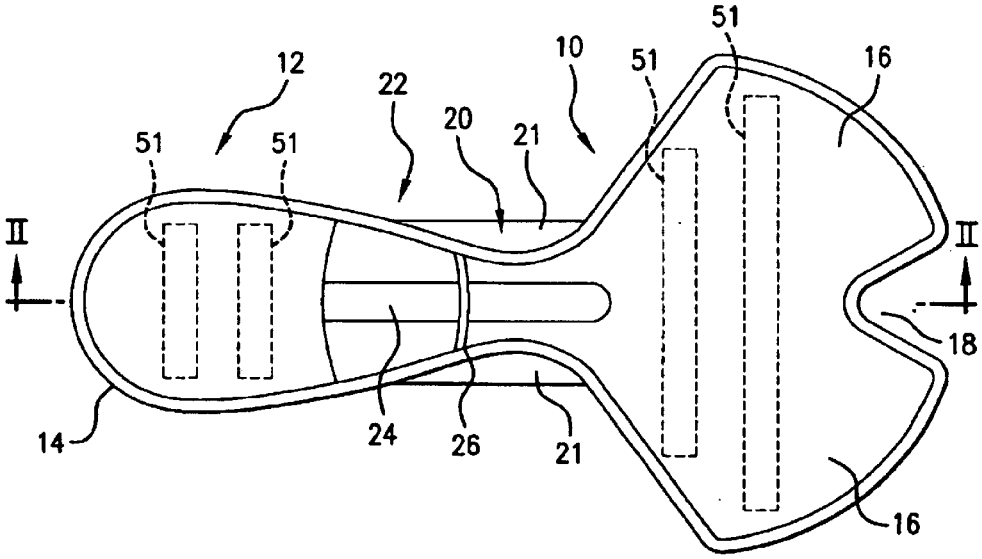
FIG. 5 is a schematic top view of the embodiment shown in FIG. 1 with an adhesive coating on the outside of the seat element configured in stripes vertical to the longitudinal direction of the seat element.

In another embodiment of the present invention, as shown in FIG. 4, an outside 30 of the seat element may be provided with an adhesive coating 50. In yet another embodiment of the present invention, as shown in FIG. 5, the adhesive coating covers the outside only partially and comprises stripes 51 extending preferably vertically to the longitudinal direction of the seat element.

Preferably, the seat pad is perforated to improve the respiratory activity. Particularly, the protective element 12 is perforated to avoid an increased heating or an accumulation of heat in this region.

What is claimed is:

1. A seat element for being inserted into a pair of cycling pants, comprising:

a seat pad for padding a seat surface in a bottom region of a person wearing the seat element;

a bowl-shaped protective element for protecting a male genital region, connected with the seat pad; and an outside of the seat element is provided with an adhesive coating.

2. The seat element according to claim 1, characterized in that an edge of the protective element is configured to at least partially contacts the skin of the person wearing the seat element.

3. The seat element according to claim 1, characterized in that the adhesive coating covers the outside of the seat element only partially and optionally is configured in the form of stripes.

4. The seat element according to claim 1, characterized in that a connection element for the connection to the cycling pants is provided at an outside of the seat element.

5. The seat element according to claim 1, characterized in that the seat pad comprises a vein protection channel in longitudinal direction.

6. The seat element according to claim 5, characterized in that the vein protection channel extends at least to the protective element.

7. The seat element according to claim 2, wherein the edge of the protective element is configured to completely surround an outer region of the male genital region of the person wearing the seat element.

8. The seat element according to claim 4, characterized in that the connection element is provided at an outside of the seat pad of the seat element.

9. A seat element for insertion into a pair of cycling pants, the seat element comprising:

a seat pad for padding a seat surface in a bottom region of a male person wearing the seat element;

a bowl-shaped protective element configured to arrange the penis and testicles of the male person within the protective element, wherein the protective element is connected with the seat pad; and an outside of the seat element is provided with an adhesive coating.

10. A seat element according to claim 9, wherein the seat pad comprises a vein protection channel formed in a crotch region of the seat pad.

11. A seat element according to claim 10, wherein the seat pad further comprises a narrowing in a middle portion, and wings made of soft cloth or a material comprising polyamide are provided in a region of the narrowing.

12. A seat element according to claim 11, wherein the adhesive coating is either silicone or a silicone compound.

13. A seat element according to claim 12, wherein the protective element includes a soft and elastic edge.

14. A seat element for insertion into a pair of cycling pants, the seat element comprising:

a seat pad arranged in a rear portion of the seat element;

a bowl-shaped protective element arranged in a front portion of the seat element and connected to the seat pad, wherein the protective element is configured to arrange penis and testicles of a male person wearing the seat element within the protective element; and a groove formed in a middle portion of the seat element and disposed between a narrowing in the middle portion and the protective element, wherein the groove permits the movement of the protective element relative to the seat pad.

15. A seat element according to claim 14, wherein an outside of the seat element is provided with an adhesive coating.

16. A seat element according to claim 15, wherein the seat pad comprises a vein protection channel formed in a crotch region of the seat pad.

* * * * *